United States Patent [19]

Browning

[11] 4,360,062

[45] Nov. 23, 1982

[54] METHOD OF GASEOUS DETONATION FRACTURING OF WELLS

[75] Inventor: James A. Browning, Hanover, N.H.

[73] Assignee: Browning Engineering Corporation, Hanover, N.H.

[21] Appl. No.: 243,108

[22] Filed: Mar. 12, 1981

[51] Int. Cl.[3] ..... E21B 43/26

[52] U.S. Cl. ..... 166/299; 166/63; 166/308

[58] Field of Search ..... 166/299, 308, 59, 63, 166/191; 102/312, 313; 175/2, 4.54

[56] References Cited

U.S. PATENT DOCUMENTS

| | | | |
|---|---|---|---|
| 1,861,332 | 5/1932 | Waitz | 166/191 X |
| 2,895,555 | 7/1959 | De Priester | 166/59 |
| 3,616,857 | 11/1971 | Pitkethly | 166/299 |
| 3,674,093 | 7/1972 | Reese | 166/299 |
| 3,718,088 | 2/1973 | Bearden et al. | 166/308 X |
| 3,744,579 | 7/1973 | Godfey | 166/63 X |
| 3,848,674 | 11/1974 | McColl | 166/299 |
| 4,049,056 | 9/1977 | Godfrey | 166/299 |
| 4,103,743 | 8/1978 | Paul | 166/299 |

FOREIGN PATENT DOCUMENTS

| | | | |
|---|---|---|---|
| 1007160 | 3/1977 | Canada | 166/299 |

*Primary Examiner*—James A. Leppink
*Assistant Examiner*—George A. Suchfield
*Attorney, Agent, or Firm*—Sughrue, Mion, Zinn, Macpeak & Seas

[57] ABSTRACT

A portion of an earth well bore is sealed off, and a combustible mixture of gaseous oxidizer and fuel is introduced into a sealed length of the well bore and ignited with substantial momentary pressure rise, fracturing the earth formation adjacent the well bore to increase the flow of fluid from the surrounding earth into the well. A check valve intermediate of the sealed well bore length functions to segregate the well bore into upper and lower sealed portions. By igniting a fuel gas mixture within the first sealed length, there is created a momentary high pressure wave within the sealed volume that is transmitted as a standing pressure into the second sealed volume. Successive firings of combustible mixtures in the first sealed volume create a steady pressure in the second sealed volume nearly equivalent to the peak transitory pressures realized in the first sealed volume during the individual firings.

2 Claims, 5 Drawing Figures

METHOD OF GASEOUS DETONATION FRACTURING OF WELLS

FIELD OF THE INVENTION

This invention relates to the controlled fracturing of rock adjacent to well bores to increase fluid flow rates for natural gas, petroleum, water, etc.

BACKGROUND OF THE INVENTION

Conventionally, a rock formation bearing a well bore hole may be fractured to increase fluid flow rates through the use of high pressure water to create cracks or increase the size of cracks in the surrounding rock. Since water is essentially non-compressible, a great deal of pump work must be effected to open up a sizeable amount of voids contained in the cracks. Typically, water must be raised to several thousands of pounds pressure per square inch, pumped into the well hole or bore, and a typical well may require as much as 20,000 gallons of water under high pressure to achieve any effective rock fracturing about the well bore. Such equipment to achieve that end is formidable in size, complexity and cost. In most cases, drilling at another location represents a less expensive choice.

SUMMARY OF THE INVENTION

The present invention is directed to a process of raising the pressure within a well hole or well bore extending into the earth by the introduction of a combustible mixture of a gaseous oxidizer and a fuel to a sealed length of the well bore or bore hole, and igniting the mixture. The resulting combustion raises the pressure of the gas momentarily to a substantial value such that the pressure rise increases the flow of fluid from the surrounding earth into the well by fracturing the rock surrounding the well or bore hole. The oxidizer may comprise pure oxygen, compressed air or a mixture of the two. By varying the pressure to which the reactants are raised prior to ignition, the peak combustion pressure may be thereby controlled. Preferably, the combustion pressure increase is transmitted into or through a volume of liquid contained below the fuel and gaseous oxidizer mixture wherein combustion occurs. The process has application to water wells, oil wells or gas wells. The bore hole may be sealed at the top thereof by a packer. Preferably, the top packer is designed to allow the flow of reactant to a sealed bore hole volume below the top packer, and the top packer is provided with ignition means to ignite combustion of the fuel and gaseous oxidizer.

The process may involve the segregation of the well or bore hole into upper and lower sealed lengths separated by a check valve with the process steps involving the introduction of the combustible mixture of the gaseous oxidizer and fuel into the first sealed length of the well or bore hole and the ignition of the mixture within that sealed length to create a momentary high pressure wave within the upper sealed volume. The check valve opens to transmit the pressure wave into a second sealed volume of the well or bore hole, thereby allowing a step-wise increase of the pressure in the second sealed chamber. Successive firings of combustible mixtures in the first sealed volume may function to create a steady pressure in the second sealed volume nearly equivalent to the peak transitory pressures realized during combustion in the first sealed volume.

A better understanding of the principles of the invention may be appreciated from a study of the figures.

DESCRIPTION OF THE PREFERRED EMBODIMENTS

Figure 1A:
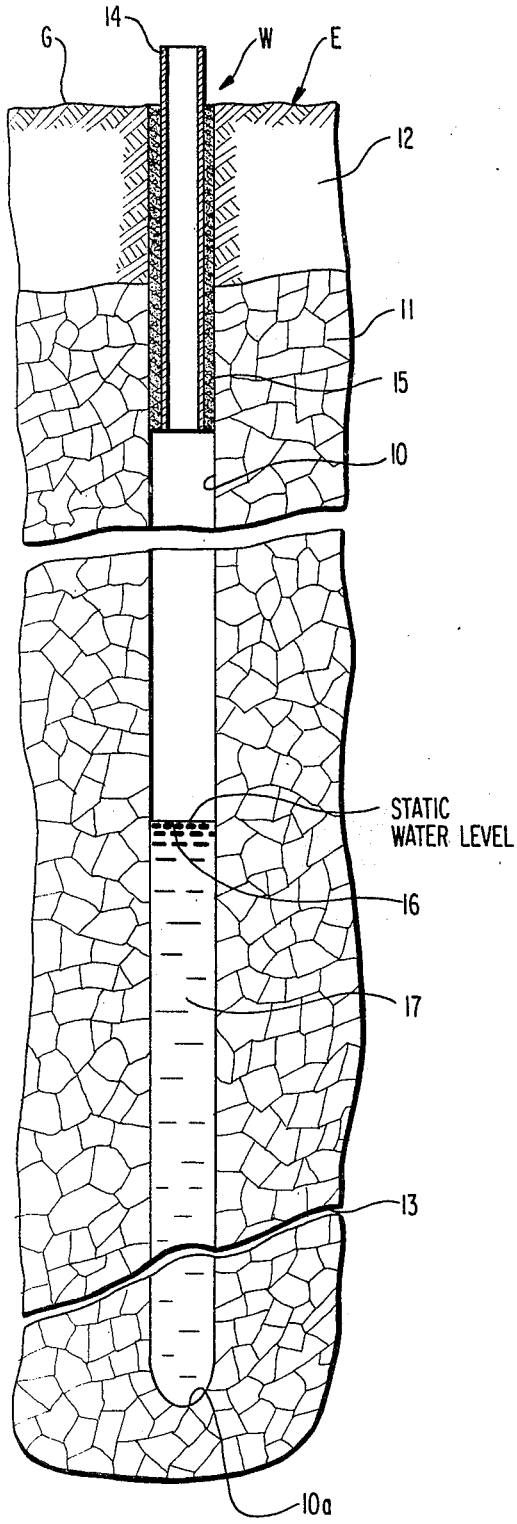
FIG. 1*a* is a vertical sectional view of a water well for gaseous detonation fracturing under the method of the present invention.

The present invention has general application to wells or bore holes for the extraction of fluids such as natural gas, petroleum or water from earth formations. In that regard, reference to FIG. 1*a* shows a typical water well indicated generally at W formed by drilling a well bore or bore hole 10, which bore hole 10 is drilled vertically downwardly within an earth formation, indicated generally at E, from ground level G. The bore hole 10 passes through an outer surface layer of soil as at 12 and thence through rock 11 to a vertical distance below an inclined crack 13 within the rock 11. Water contained in the ground follows the seam of the crack 13 and collects within the bore hole 10 to a given level as at 16 and forming a volume of water 17 therein.

For illustration purposes, an assumption is made that the rate of water inflow from crack 13 to bore hole 10 is relatively low, for instance one-half gallon per minute. Where an increased flow is required, the choice is limited to either drilling of the bore hole 10 deeper to encounter further cracks, where water may seep to the bore hole 10 or the drilling of a new well at another location, unless an increased flow from existing cracks 13 may be achieved.

Typically, the well driller will attempt to increase the water flow by blasting several sticks of dynamite placed within the bottom 10*a* of the bore hole 10. Often this is successful, and the crack as at 13 opens further into the rock formation 11 intercepting additional zones bearing water. Further, the crack 13 may be widened which may function to allow an increased flow. However, in many cases, the intense blast created by the detonation of the dynamite or explosive results in considerable damage to the well. If excessive, it simply precludes further use as a water or other liquid source.

As an alternative to blasting, conventionally, hydrofracturing is employed. This involves the application of water raised to several thousands pounds of pressure per square inch and pumped into the hole. A typical well of extended length may require as much as 20,000 gallons of water. The equipment required to achieve hydrofracturing is formidable in size, complexity and cost.

In hydrofracturing, there is a requirement that cylindrical casing formed of a strong metal be securely attached to the rock formation 11 and projecting downwardly from a point in the vicinity of the ground level. Physical attachment is normally effected by means of a mass of concrete, as at 15, poured between the well bore 10 and the earth formation, whether it be the soil 12 or the rock 11, and wherein most of the attachment of the casing 14 is effected between the casing 12 and the rock formation 11 through which casing 14 passes.

Figure 1B:
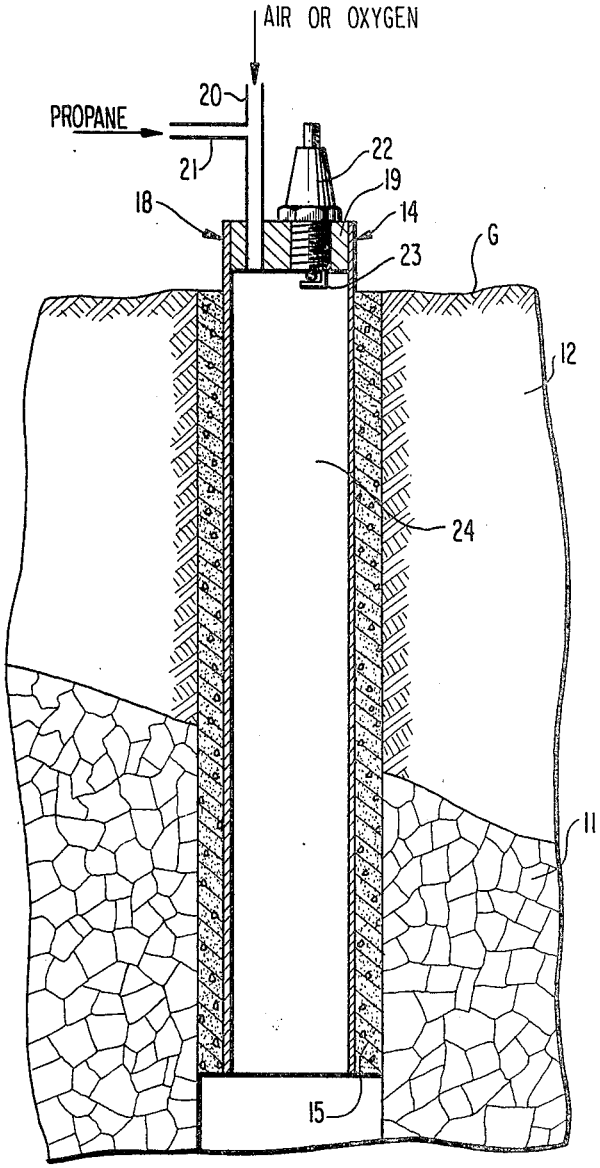
FIG. 1*b* is an enlarged vertical sectional view of the water well shown in FIG. 1*a* using the method of gaseous detonation in the well for rock fracturing.

The present invention involves effecting a gaseous detonation by an effective, simple and inexpensive manner within the well bore 10. As seen in FIG. 1*b*, which is an enlarged vertical sectional view of the well W of FIG. 1*a*, a cap 18 or a special packer is sealably and fixedly mounted to the upper end of casing 14 and the interior of the bore hole 10 is sealed off from the outside at or near ground level G. Cap 18 may take the form of a rather thick metal plate as at 19, as shown, welded to the top of casing 14 and projecting interiorly within the same. Alternatively, a "packer" of conventional design may be employed. The plate 19 bears a supply tube 20 through which air or oxygen is supplied to the interior of the extended bore of volume 24, as formed by casing 14, along with a supply of propane or other gaseous or liquid fuel by way of tube 21, the oxidizer and fuel being fed under pressure as indicated by the arrows respective to tubes 20 and 21. Tube 21 forms a Tee with tube 20, such that both the fuel and gaseous oxidizer are supplied under pressure to the interior of bore hole 10 via sealed casing 14. Alternatively, air, oxygen or a mixture of both may be passed through tube 20 under pressure to the interior of casing 14. The fuel and oxidizer mixture (optionally stociometric) is pumped into the bore hole volume 24 until a determined desired pressure is realized throughout the extent of the captive volume of fuel and oxidizer mixture. The mixture is ignited by energizing a spark plug 22 and the creation of a spark across gap 23 between the points of the electrodes of spark plug 22.

Depending upon the gas pressure prior to ignition, the peak pressure reached by the detonation or deflagrating (gases) can be controlled.

EXAMPLE NO. 1

Assuming the static level 16 of water 17 within the bore hole 10 to be 100 feet below the cap 18 at the top of casing 14 and with a well diameter averaging seven inches, the filling of the bore hole 10 with a combustible gas mixture to 500 psig requires approximately 915 cubic feet of gas measured at standard pressure and temperature (14.7 psig and 60° F.). If the oxidizer is air, the weight of this amount of air is about 60 pounds. Thus, the fuel/gas component is only about five pounds or one-twentieth the standard 100 pound tank of propane. However, this amount of propane represents a tremendous quantity of energy.

The peak pressure of combustion can be estimated using standard combustion equations. Assuming perfect, stociometric combustion of air plus propane $$C_3H_8+5O_2+18.8N_2 \rightarrow 3CO_2+4H_2O+18.8N_2$$

24.8 moles of reactants form 25.8 moles of products. Assuming a peak combustion temperature of 3,600° F., the adiabatic maximum gas pressure becomes $$500\left(\frac{25.8}{24.8}\right)\left(\frac{4{,}060}{520}\right),$$

or 4,061 psig. The actual peak pressure will be somewhat less due to heat loss to the well bore hole walls.

Figure 3:
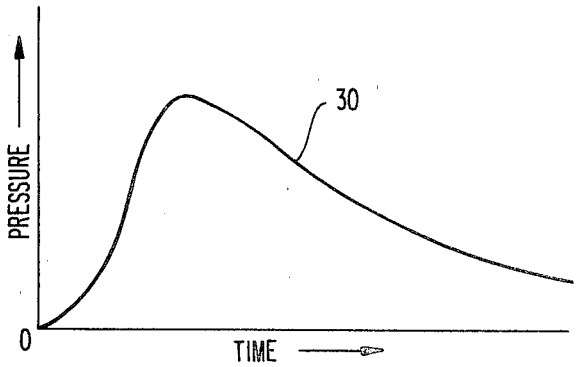
FIG. 3 is a pressure time curve for a typical gaseous detonation employed in the detonation fracturing method of the present invention.

An advantage of the gaseous detonation method of the present invention is the controlled rise of the pressure curve. It is not the nearly instantaneous and destructive pressure rise resulting from the ignition of a solid explosive. FIG. 3 constitutes a pressure/time curve of a typical gaseous detonation within a long bore hole 10. The curve 30 shows that the pressure rises rapidly (but not destructively) to its maximum value and then the pressure decays slowly as the heat from the gas passes into the cold rock 11.

The peak pressure of over 4,000 psig is usually more than sufficient to open and extend tight cracks such as crack 13 within the rock 11, FIG. 1*a*. In some cases, higher initial pressures may be required. In others, sand grains may be added to the well water 17 and upon detonation, the increased pressure forces the sand into the cracks to help keep the cracks open once the pressure wave has passed longitudinally.

EXAMPLE NO. 2

Alternatively, pure oxygen may be used in place of compressed air. Again, assuming perfect, stociometric combustion of oxygen plus propane $$C_3H_8+5.5O_2 \rightarrow 3CO_2+4H_2O$$

Six moles of reactants create seven moles of products. Again, assuming an initial pressure of 500 psig and a peak combustion temperature of 5,400° F., the peak pressure reaches 6,900 psig neglecting heat losses. This is nearly double that for compressed air and heat outputs are increased several-fold. Propane consumption increases to about twenty-five pounds per firing.

Figure 2:
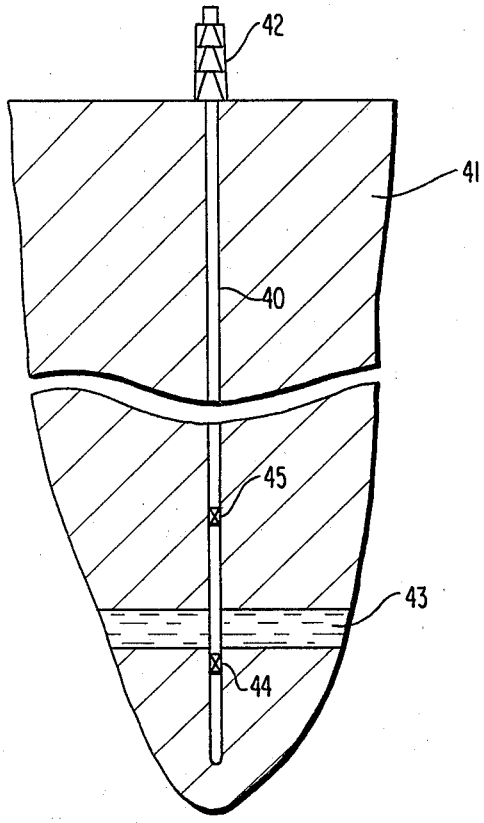
FIG. 2 is a vertical sectional view of a deep oil well illustrating a modified form of the gaseous detonation fracturing method of the present invention.

In the illustrated embodiment of FIGS. 1*a*/1*b*, the packer or plate 19 is positioned at the top of the cylindrical steel casing 14. In deep wells, regardless of whether the deep wells are oil or water, the packer may be positioned deep in the bore hole 10 to limit the volume of combustion required to achieve the pressure needed to create or extend the cracks. Reference to FIG. 2 illustrates a well bearing an alternate arrangement to achieve a fluid flow rate input under gaseous detonation. In this case, the well bore or bore hole 10 extends vertically through the earth 41 and through a petroleum bearing seam 43 to a point below the seam. Preferably two packers are set, one at 44 just below the oil bearing seam 43 and the other, 45, at some point above seam 43 but well below rig 42. It is the volume of the portion of bore 40, between the packers 44 and 45, which controls the extent of combustion reaction and the maximum pressure achieved within that portion of the bore hole. The packer 45 functions in addition to sealing off a portion of the bore hole 40, as the means for providing the oxidizer and fuel mixture under pressure via a tubing or piping similar to that of 20–21 of FIG. 1*b*, and the packer 45 further bears a spark plug and other elements of an ignition system for achieving sparking and thus ignition of the fuel oxidizer mixture within the portion of bore hole 40 segregated by packers 44 and 45.

Combustion is effected in the manner of the embodiment of FIGS. 1*a*, 1*b*.

Figure 4:
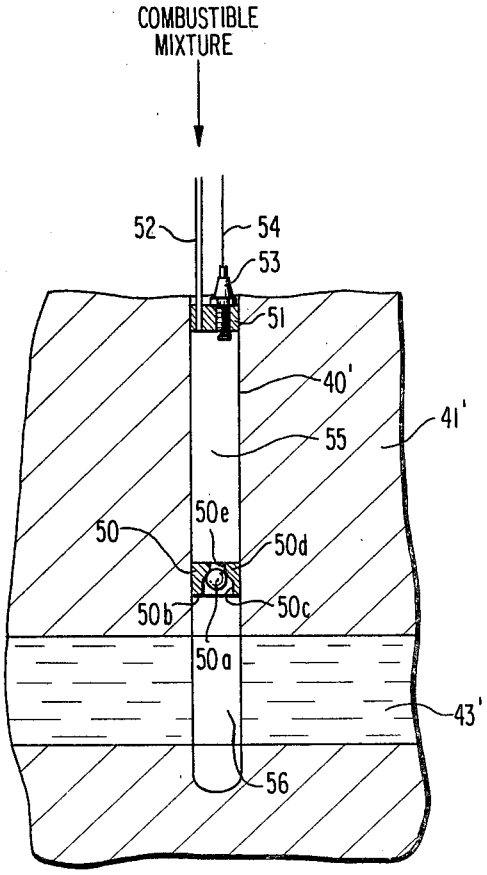
FIG. 4 is a vertical sectional view of a well employing a modified set up for utilizing an alternate gaseous detonation process forming yet another embodiment of the present invention.

Turning next to FIG. 4, the method of the present invention involves a slight modification in which two packers are provided to a well bore hole as at 40' within an earth formation 41' with the bore hole 40' terminating just below a petroleum formation 43'. In this case, an upper or top packer 51 receives reactants which pass through the top packer 51 via a supply tube 52 under pressure, as indicated by the arrow, the combustible mixture filling the space 55 between upper or top packer 51 or a lower or bottom packer 50. The lower packer 50 takes the form of a check valve including a ball valve member 50*a* which is borne within a larger diameter axial passage portion 50*c* within plate 50*d*. The ball 50*a* is prevented from falling into the bore hole by a perforated screen as at 50*b*. The ball 50*a* has a diameter slightly larger than passage portion 50*e* which is open to a larger diameter passage portion 50*c*. The packer 51 is provided with a spark plug as at 53 corresponding to spark plug 22 of the embodiment of FIG. 1*b*. Electrical current is applied via line 54 to spark plug 22. While pressurization occurs in bore chamber portion or volume 55 as well as the lower bore hole portion or chamber 56, beneath packer 50, the ignition of the fuel and oxidizer mixture in gaseous form in the vicinity of the spark plug 53 causes a pressure wave in the combustion volume, captured between the packers 50 and 51, to pass through the check valve, thus raising the pressure in the petroleum formation 43'. Multiple firings are used to raise this pressure to very high value with the pressure within volume 56 being much greater than the residual pressure value within volume 55. In this way, a steady pressure may be imposed upon the petroleum bearing rock, in place of pulse pressure rises. For multiple firings, means must be provided to remove the products of combustion of each firing, replacing them with fresh reactants. Such means would normally involve the piping or tube 52 leading to volume 55. Obviously, for all embodiments, the tube 52 may be sealed off to the source of the combustible mixture prior to ignition of the confined and sealed volume in chambers such as 55 and 24 for embodiments of FIG. 4 and FIG. 1*b*, respectively.

As may be appreciated, the invention has application to a drilled well or even a natural well, and references to terms such as well bore or bore hole are not intended to be limited to a hole within an earth formation achieved through conventional drilling techniques to effect creation of a vertical or inclined bore hole.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. A process of raising the pressure within a well bore hole extending into an earth formation to increase the flow of fluid from the surrounding earth into the well bore hole, said process comprising the steps of:

introducing a combustible mixture of a gaseous oxidizer and a fuel into a first sealed length of said well bore hole, igniting said mixture within said first sealed length to create a momentary high pressure wave within said first sealed length, and transmitting said pressure wave into a second sealed length of said well bore hole connected to said first sealed length by means of check valve to facilitate a stepwise increase of pressure in said second sealed length such that the increased pressure within said second sealed length functions to fracture the surrounding rock and thereby to release fluid to said well bore hole.

2. The process as claimed in claim 1, further comprising the steps of:

producing successive firings of combustible mixtures in said first sealed length of said well bore hole to create a steady pressure in said second sealed length nearly equivalent to the peak transitory pressures realized in said first sealed length during said firings.

* * * * *